United States Patent [19]

Luckenbach

[11] 4,243,518

[45] Jan. 6, 1981

[54] EXTERNAL METHOD FOR REDUCING TRANSVERSE OXYGEN GRADIENTS IN FCCU REGENERATION

[75] Inventor: Edward C. Luckenbach, Mountainside, N.J.

[73] Assignee: Exxon Research & Engineering Co., Florham Park, N.J.

[21] Appl. No.: 58,491

[22] Filed: Jul. 18, 1979

Related U.S. Application Data

[63] Continuation-in-part of Ser. No. 866,496, Jan. 3, 1978, abandoned.

[51] Int. Cl.[3] ..... C10G 11/18

[52] U.S. Cl. ..... 208/164; 208/DIG. 1

[58] Field of Search ..... 208/DIG. 1, 164

[56] References Cited

U.S. PATENT DOCUMENTS

| | | | |
|---|---|---|---|
| 2,589,124 | 3/1952 | Packie | 208/164 |
| 3,206,393 | 9/1965 | Pohlenz | 208/164 |
| 4,035,284 | 7/1977 | Gross et al. | 208/164 |

*Primary Examiner*—Herbert Levine

*Attorney, Agent, or Firm*—John W. Ditsler; Edward H. Mazer

[57] ABSTRACT

A minor portion of the regeneration gas used to regenerate spent fluid catalytic cracking catalyst is employed to combust volatile hydrocarbons in mixture with said spent catalyst prior to said mixture entering the regeneration zone. This serves to reduce and/or minimize transverse oxygen gradients in the dense phase catalyst bed and in the effluent gases therefrom such that excessive or undesirable afterburning in the dilute catalyst phase can be minimized or eliminated.

19 Claims, 3 Drawing Figures

EXTERNAL METHOD FOR REDUCING TRANSVERSE OXYGEN GRADIENTS IN FCCU REGENERATION

CROSS-REFERENCE TO RELATED APPLICATIONS

This application is a continuation-in-part of U.S. Ser. No. 866,496, filed Jan. 3, 1978 now abandoned.

BACKGROUND OF THE INVENTION

1. Field of the Invention

The present invention relates to the regeneration of catalysts employed in a fluid catalytic cracking process. More particularly, this invention relates to the combustion of volatile hydrocarbons in mixture with spent fluid catalytic cracking catalyst prior to said mixture entering the regeneration zone.

2. Description of the Prior Art

The fluidized catalytic cracking of hydrocarbons is well known in the prior art and may be accomplished in a variety of processes which employ fluidized solid techniques. Normally in such processes, suitably preheated, relatively high molecular weight hydrocarbon liquids and/or vapors are contacted with hot, finely-divided, solid catalyst particles either in a fluidized bed reaction zone or in an elongated riser reaction zone, and maintained at an elevated temperature in a fluidized state for a period of time sufficient to effect the desired degree of cracking to lower molecular weight hydrocarbons typical of those present in motor gasolines and distillate fuels.

During the cracking reaction, coke is deposited on the catalyst particles in the reaction zone thereby reducing the activity of the catalyst for cracking and the selectivity of the catalyst for producing gasoline blending stock. In order to restore a portion, preferably a major portion, of the activity to the coke contaminated or spent catalyst, the catalyst is transferred from the reaction zone into a regeneration zone. Typical regeneration zones comprise large vertical cylindrical vessels wherein the spent catalyst is maintained as a fluidized bed by the upward passage of an oxygen-containing regeneration gas, such as air. The fluidized catalyst forms a dense phase catalyst bed in the lower portion of the vessel and a dilute catalyst phase containing entrained catalyst particles above, with an interface existing between the two phases. The catalyst is contacted with the oxygen-containing regeneration gas under conditions sufficient to burn at least a portion, preferably a major portion, of the coke from the catalyst. Flue gas, which normally comprises gases arising from the combustion of the coke on the spent catalyst, inert gases such as nitrogen from air, any unconverted oxygen and entrained catalyst particles, is then passed from the dilute catalyst phase into solid-gas separation means within the regeneration zone (e.g., cyclone separators) to prevent excessive losses of the entrained catalyst particles. The catalyst particles separated from the flue gas are returned to the dense phase catalyst bed. A substantially catalyst-free flue gas may then be passed from the separation means to equipment downstream thereof, for example to a plenum chamber, or be discharged directly from the top of the regeneration zone. The regenerated catalyst is subsequently withdrawn from the regeneration zone and reintroduced into the reaction zone for reaction with additional hydrocarbon feed.

Commonly, spent catalyst from the reaction zone is passed therefrom to a stripping zone for removal of volatile hydrocarbons from the catalyst particles prior to transferring the catalyst to the regeneration zone. However, the volatile hydrocarbons not recovered as product from the reaction zone will pass with the spent catalyst into the regeneration zone wherein they are combusted in preference to the carbon on the spent catalyst. This results in exhaustion of the oxygen in the regeneration gas in the area where the spent catalyst and volatile hydrocarbons enter the regeneration zone. Normally, the spent catalyst and volatile hydrocarbons enter the regeneration zone at an off-center location to avoid interference with the regeneration overflow well and/or auxiliary heating air section. Thus, one area of the dense phase bed is essentially starved of oxygen such that CO rather than $CO_2$ will be formed. In contrast, an excess of oxygen is present in the remaining portion of the dense phase bed since volatile hydrocarbons are not present therein.

The CO thus formed in this localized area passes from the dense phase bed into the dilute catalyst phase where it is reacted with oxygen leaving the oxygen-rich portions from other parts of the dense phase bed according to the following equation, an exothermic reaction:

$$2CO + O_2 \rightarrow 2CO_2 \quad (1)$$

This oxidation of carbon monoxide is commonly referred to as "afterburning" when it occurs in the dilute catalyst phase (see "Oil and Gas Journal", Vol. 53, No. 3, pp. 93–94, 1955, for further discussion). The "afterburning" causes a substantial increase in the temperature of the dilute catalyst phase which may exceed about 1500° F. Such high temperatures in the dilute catalyst phase can cause deactivation of the small amounts of catalyst still present, thereby requiring additional catalyst replacement to the process in order to maintain a desired catalytic activity in the hydrocarbon reaction zone. Additionally, these high temperatures may cause damage to mechanical components of the regeneration zone, particularly in that portion of the regeneration zone in contact with the substantially catalyst-free flue gas wherein the temperature may increase to 1800° F. or greater. Such high temperatures are realized because the reaction shown in equation (1) proceeds rapidly within the substantially catalyst-free flue gas since there is very little entrained catalyst present to absorb the heat released, and thereby reduce the rise in temperature. Thus, in that portion of the regeneration zone wherein the flue gas is substantially catalyst-free, there will occur a rapidly accelerating rise in temperature due to the heat released as complete combustion of carbon monoxide occurs in the absence of any means to moderate the temperature therein.

Thus, in view of the undesirable consequences resulting from the combustion of volatile hydrocarbons in the regeneration zone, it would be desirable to have a simple and convenient method for removing said hydrocarbons prior to their entering said regeneration zone.

SUMMARY OF THE INVENTION

Now according to the present invention, it has been discovered that the formation of CO in the dense phase catalyst bed of the regeneration zone of a fluid catalytic cracking process due to the volatile hydrocarbons in the spent catalyst mixture entering said regeneration zone may be reduced and/or minimized by using a minor portion of the regeneration gas to combust said hydrocarbons prior to said mixture entering the regeneration zone. The amount of regeneration gas used to combust the hydrocarbons is not critical, and, typically, will range from about 2 to about 20% of the regeneration gas normally employed. Preferably combustion of the hydrocarbons will occur in the line transferring spent catalyst from the reaction zone to the regeneration zone.

DETAILED DESCRIPTION OF THE INVENTION

Figure 1:
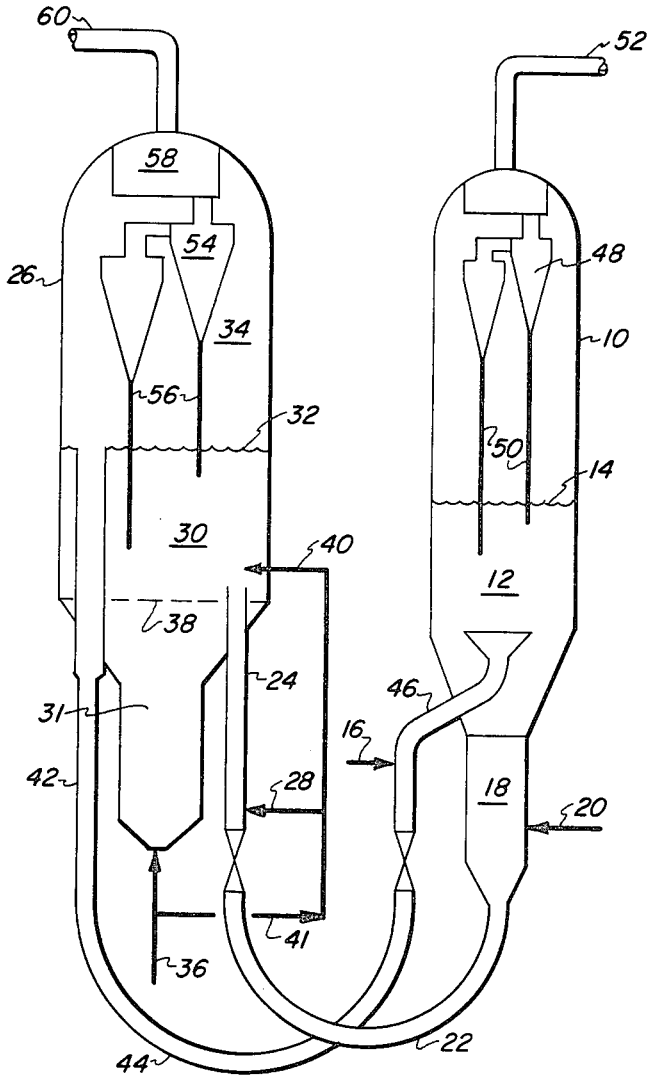
FIG. 1 is a flow diagram of an embodiment of the present invention as applied to a pressure controlled type fluid catalytic cracking process.
Figure 2:
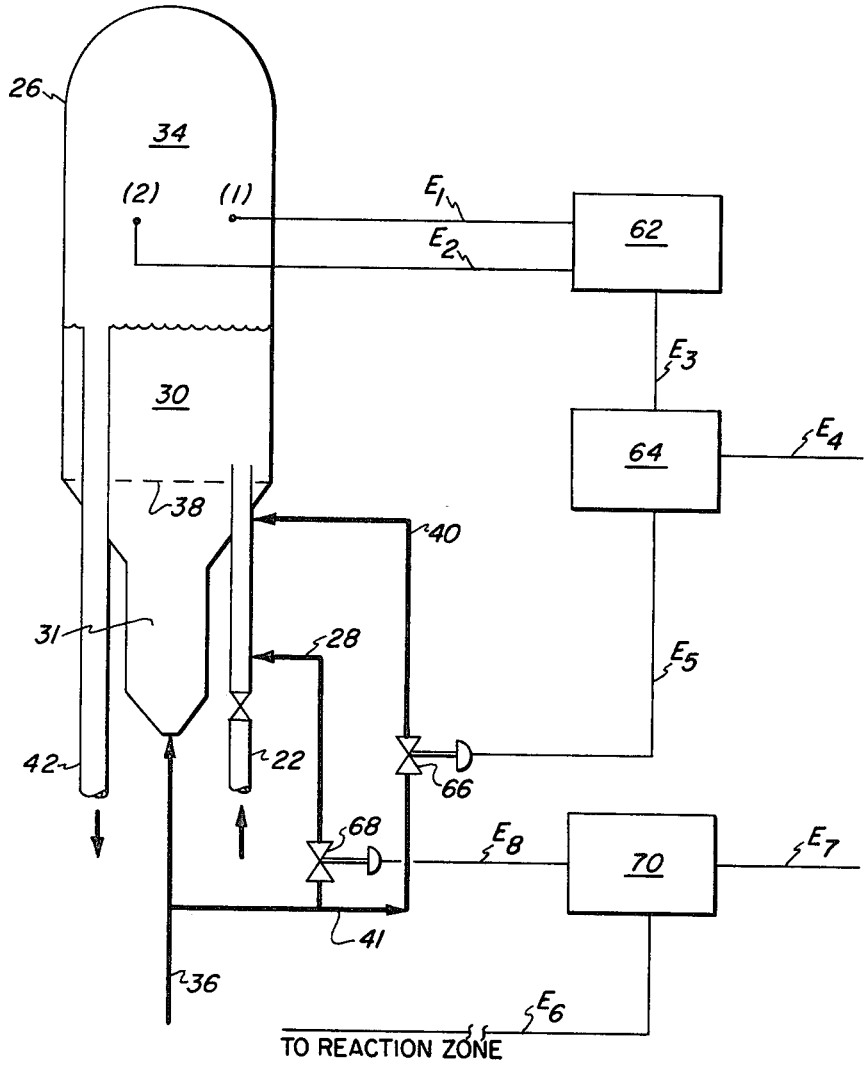
FIG. 2 shows a more detailed view of the embodiment of FIG. 1.
Figure 3:
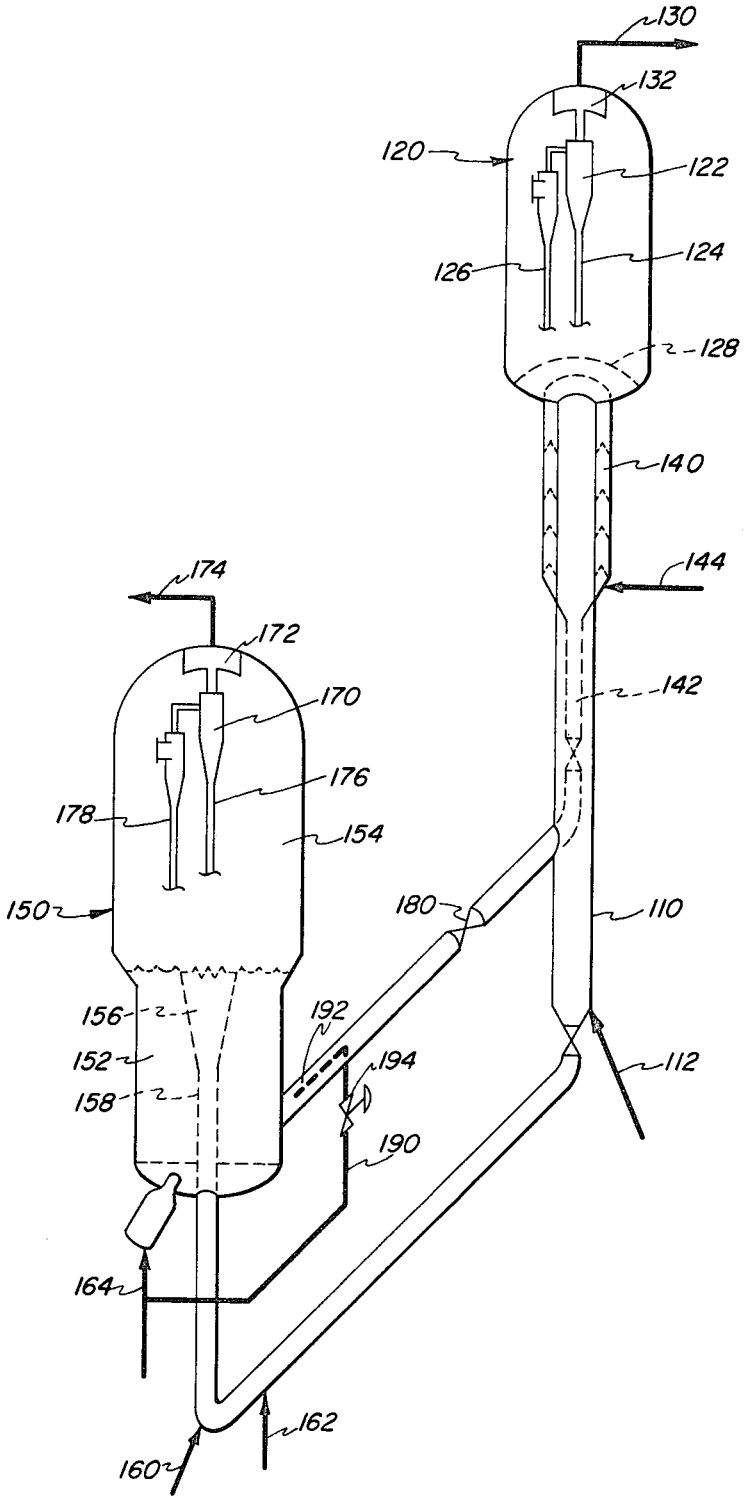
FIG. 3 is an alternate embodiment of the present invention as applied to a slide valve type fluid catalytic cracking process.
Figure 1:
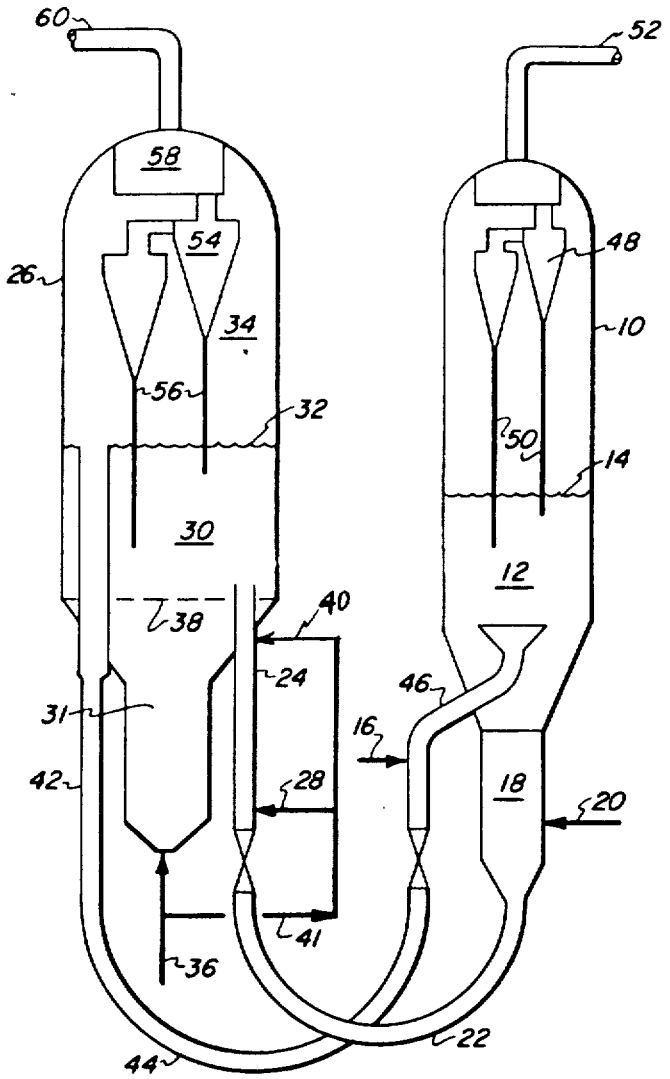

Having thus described the invention in general terms, reference is now made to the figures which illustrate two embodiments in which the present invention is applied to a fluid catalytic cracking process. FIGS. 1 and 2 disclose a catalyst cracking system in which the catalyst circulation rate is controlled either by adjusting the differential pressure between the zones by suitable control means or by varying the catalyst density in the riser entering the regeneration zone. FIG. 3 illustrates a system in which the catalyst flow rate between the reaction and regeneration zones is controlled by a slide valve. The subject invention is not limited to these type systems and is equally applicable to other type cracking systems and to other zone configurations and positions such as upflow and downflow regeneration systems with and without slide valves. Various items such as valves, pumps, compressors, steam lines, instrumentation and other process equipment and control means have been omitted from the figures for the sake of simplicity. Variations obvious to those having ordinary skill in the art of catalyst regeneration processes are included within the broad scope of the present invention.

Referring now to FIG. 1, there is shown a vertically arranged cylindrical reaction zone 10 containing a fluidized bed 12 of catalyst having a level indicated at 14 in which a hydrocarbon feedstock introduced at line 16 is undergoing catalytic cracking. Hydrocarbon feedstocks that can be suitably employed in a fluid catalytic cracking process include naphthas, light gas oils, heavy gas oils, wide-cut gas oils, vacuum gas oils, kerosenes, decanted oils, residual fractions, reduced crude oils, cycle oils derived from any of these, as well as suitable fractions derived from shale oil kerogen, tar sands bitumen processing, synthetic oils, coal hydrogenation, and the like. Such feedstocks may be employed singly, separately in parallel reaction zones, or in any desired combination. Hydrocarbon gas and vapors passing through fluid bed 12 maintain the bed in a dense turbulent fluidized condition having the appearance of a boiling liquid.

In reaction zone 10, the cracking catalyst becomes spent during contact with the hydrocarbon feedstock due to the deposition of coke thereon. Thus, the terms "spent" or "coke-contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 wt. % or more. Typically, spent catalyst coke contents vary from about 0.5 to about 1.5 wt. %.

Prior to actual regeneration, the spent catalyst is usually passed from the reaction zone into a stripping zone 18 and contacted therein with a stripping gas, which is introduced into the lower portion of zone 18 via line 20. The stripping gas, which is usually introduced at a pressure of from about 10 to about 50 psig, serves to remove most of the volatile hydrocarbons from the spent catalyst. A preferred stripping gas is steam, although nitrogen, other inert gases or flue gas may be employed. Normally, the stripping zone is maintained at essentially the same temperature as the reaction zone, i.e., from about 850° to about 1100° F.

Stripped spent catalyst from which most of the volatile hydrocarbons have been stripped therefrom, is then passed from the bottom of stripping zone 18, through a spent catalyst transfer line, such as U-bend 22 and interconnected vertical riser 24, which extends into the lower portion of a regeneration zone 26.

Riser 24 is shown entering regeneration zone 26 off-center to avoid interference with the auxiliary heating air from section 31 of the regeneration zone. In the embodiment shown, only one riser 24 is utilized. It is, however, within the contemplation of the subject invention that a plurality of risers may be used.

Air is added to riser 24 through line 41 and line 28 in an amount sufficient to reduce the density of the catalyst flowing therein, thus causing the catalyst to flow upward into the regeneration zone 26 by simple hydraulic balance.

In the particular configuration shown in FIG. 1, the regeneration zone is a separate vessel (arranged at approximately the same level as reaction zone 10) containing a dense phase catalyst bed 30 having a level indicated at 32, which is undergoing regeneration to burn off coke deposits formed in the reaction zone during the cracking reaction, above which is a dilute catalyst phase 34. An oxygen-containing regeneration gas enters the lower portion of regeneration zone 26 via line 36 and passes up through a grid 38 and the dense phase catalyst bed 30, maintaining said bed in a turbulent fluidized condition similar to that present in reaction zone 10. As will be discussed in more detail hereinbelow, the present invention resides in passing a minor portion of said regeneration gas via lines 41 and 40 into riser 24 relatively close to where the riser enters regeneration zone 26 to combust the volatile hydrocarbons present therein prior to their entering the dense phase bed.

Oyxgen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen. Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec., preferably from about 1.5 to about 4 feet/sec.

Regenerated catalyst from the dense phase catalyst bed 30 in the regeneration zone 26 flows downward through standpipe 42 and passes through U-bend 44 into the reaction zone 10 by way of the transfer line 46 which joins U-bend 44 at the level of the oil injection line 16 above the U-bend. By regenerated catalyst is meant catalyst leaving the regeneration zone which has contacted an oxygen-containing gas causing at least a portion, preferably a substantial portion, of the coke present on the catalyst to be removed. More specifically, the carbon content of the regenerated catalyst can vary anywhere from about 0.01 to about 0.2 wt. %, but preferably is from about 0.01 to about 0.1.

The hydrocarbon feedstock for the cracking process is injected into line 46 through line 16 to form an oil and catalyst mixture which is passed into the fluid bed 12 within the reaction zone 10. Product vapors containing entrained catalyst particles pass overhead from fluid bed 12 into a gas-solid separation means 48 wherein the entrained catalyst particles are separated therefrom and returned through diplegs 50 leading back into fluid bed 12. The product vapors are then conveyed through line 52 into the product recovery system.

In regeneration zone 26, flue gases formed during regeneration of the spent catalyst pass from the dense phase catalyst bed 30 into the dilute catalyst phase 34 along with entrained catalyst particles. The catalyst particles are separated from the flue gas by a suitable gas-solid separation means 54 and returned to the dense phase catalyst bed 30 via diplegs 56. The substantially catalyst-free flue gas then passes into a plenum chamber 58 prior to discharge from the regeneration zone 26 through line 60. Typically, the flue gas will contain less than about 0.2, preferably less than 0.1, and more preferably less than 0.05 volume % carbon monoxide. Typically, the oxygen content will vary from about 0.4 to about 7 vol. %, preferably from about 0.8 to about 5 vol. %, more preferably from about 1 to about 3 vol. %, most preferably from about 1.0 to about 2 vol. %.

As noted above, most of the volatile hydrocarbons are stripped from the spent catalyst leaving reaction zone 10. However, the hydrocarbons not removed will be passed in mixture with spent catalyst (and steam) into regeneration zone 26 wherein said hydrocarbons are combusted in preference to the carbon on the spent catalyst. As such, the localized area where the spent catalyst mixture is released into dense phase catalyst bed 30 of the regeneration zone becomes depleted in oxygen. Thus, sufficient oxygen is not present to combust CO to $CO_2$. As such, CO will pass into dilute catalyst phase 34 from said localized area of the dense phase catalyst bed. In contrast, an excess of oxygen will be present in other areas of the dense phase bed (i.e., areas where the volatile hydrocarbons are not present) such that CO will be converted to $CO_2$ therein. As such, transverse oxygen gradients (i.e., gradients in the direction perpendicular to the flow of the regeneration gas) will exist in the bed. The gradient may be especially pronounced where only one assymetric riser 24 is used. When the CO passed into the dilute catalyst phase contacts the oxygen present therein from the other areas (i.e., oxygen-rich areas) of the bed, undesirable or excessive afterburning could occur according to equation (1).

The expression "undesirable or excessive" afterburning is meant to mean obtaining temperatures in the substantially catalyst-free flue gas system due to the combustion of carbon monoxide that exceed permissible catalyst deactivation, or materials of construction limitations and the like. In general, undesirable or excessive afterburning corresponds to temperatures above 1450° F. Preferably, however, the temperature should be maintained below about 1420° F., more preferably below about 1400° F., to avoid the undesirable effect of excessive afterburning.

However, the problems associated with transverse oxygen gradients due to the presence of volatile hydrocarbons in the dense phase bed can be virtually eliminated by combusting said volatile hydrocarbons prior to their entering the dense phase catalyst bed. This may be accomplished simply and conveniently by introducing a minor portion of the regeneration gas into the spent catalyst transfer line extending from the stripping zone 18 to the regeneration zone 26.

For the embodiment of FIG. 1 where the catalyst circulation rate is controlled by density variations caused by air injection into riser 24, the exact location at which the regeneration gas is injected is rather critical. The air should be injected at a point at which it will have little, if any, effect on circulation rate. The regeneration gas preferably is injected into riser 24 as close to regeneration zone 26 as mechanical considerations will permit. In a typical system, this point may be 5–8 feet from the discharge point of riser 24 into bed 30.

The amount of regeneration gas employed to conduct the volatile hydrocarbons is not critical. However, the amount of regeneration gas injected into the spent catalyst transfer line should be regulated somewhat to assure that only the approximate amount of regeneration gas required for combustion of the volatile hydrocarbons is added. Injection of an insufficient amount of regeneration gas will result in the continued presence of transverse oxygen gradients in regeneration zone 26. Injection of an excess amount of regeneration gas will cause excessive catalyst entrainment which might overload gas-solid separation means 54. Moreover, if a considerable excess of regeneration gas were injected into riser 24, complete combustion of the volatile hydrocarbon and the coke would be effected in the vicinity of the point where the riser enters the vessel, but incomplete combustion would occur in other areas of the regeneration zone. A transverse oxygen gradient would be created and once again afterburning would occur in dilute catalyst phase 34. The amount of regeneration gas injected into riser 24 preferably is regulated by monitoring the transverse oxygen gradient, the transverse CO gradient, or a transverse temperature gradient. A schematic diagram and a detailed description of such a control system is presented hereinafter.

The amount of air utilized may be dependent in part on the type of regeneration system utilized. Typically, this will correspond to from about 2 to about 20%, preferably from about 4 to about 15%, of the regeneration gas. In the embodiment of FIG. 1, about 0 to about 12% of the total regeneration gas enters through line 28 to control catalyst circulation, while about 2 to about 10%, and preferably about 3% to about 6%, of the total regeneration gas enters through line 40 to combust the volatile hydrocarbons.

A better understanding of how the present invention may be applied to reducing and/or minimizing excessive or undesirable afterburning may be obtained by reference to FIG. 2 which shows spent catalyst from a stripping zone (not shown) being introduced into the dense phase catalyst bed 30 of regeneration zone 26 via line 22. Also shown is regeneration gas in line 36 passing up through grid 38 and into bed 30 where it reacts with the carbon on the spent catalyst therein such that a regenerated catalyst is passed from zone 26 via line 42.

A minor portion of the regeneration gas in line 36 is shown passing through lines 41 and 28, the latter having control valve 68 therein. Operation of valve 68 controls the catalyst density which, in turn, governs the catalyst circulation rate. Operation of valve 68 may be controlled by a signal $E_8$ from a comparison means 70 which compares control signal $E_7$, corresponding to the desired temperature in reaction zone 10, to signal $E_6$, transmitting the actual temperature in the reaction zone. Typically, valve 68 is opened further to increase the catalyst circulation rate when the temperature in reaction zone 10 is too low, and, conversely, the opening in the valve is decreased when the temperature in zone 10 is too high. The catalyst circulation rate also may be varied to control other process variables such as the temperature in regeneration zone 26. An additional minor portion of the regeneration gas in line 36 is shown being passed via lines 41 and 40 into the spent catalyst line to combust volatile hydrocarbons not removed in the stripping zone which otherwise would react preferentially with the oxygen passing through grid 38, thereby causing a depletion of the oxygen in a localized area where the spent catalyst enters bed 30 such that CO rather than $CO_2$ is formed therein. This, in turn, would create transverse oxygen gradients in not only bed 30, but in dilute catalyst phase 34 when gases are passed from bed 30. Hence, undesirable or excessive afterburning would result.

However, according to one embodiment of the present invention, should such gradients exist in the dilute catalyst phase, oxygen concentrations could be sensed at, for example, spaced-apart points (1) and (2). The concentration of hydrocarbon components or non-hydrocarbon components, such as carbon monoxide, ammonia, hydrogen, or oxides of nitrogen, which are oxidizable in regeneration zone 26, alternatively could be sensed. Or, since oxygen gradients across the vessel will result in combustion of CO to $CO_2$ in the dilute phase, a temperature gradient and a $CO_2$ gradient also will be formed which alternatively may be sensed by spaced-apart points (1) and (2). In the embodiment shown, points (1) and (2) are preferably disposed in a horizontal plane generally transverse to the direction of flow of the regeneration gas. However, with suitable biasing, points (1) and (2) could be located at any spaced-apart locations in dilute phase 34 at which differences resulting from the oxygen gradient could be detected. In either event, signals $E_1$ and $E_2$ corresponding to the sensed temperatures or oxygen concentrations at points (1) and (2), respectively, could be developed and passed into a computation means 62 suitable for calculating a transverse oxygen or temperature gradient. Suitable computation means can be selected from a variety of digital and/or analog computing devices, depending upon the particular application. For example, the computation means could be a large computer capable of controlling an entire refinery complex or, if desired, a minicomputer designed for more limited applications. Such computation means are well known articles of commerce and thus are readily available in the marketplace.

The oxygen, temperature or other gradient thus calculated can then be developed into a control signal $E_3$ and sent to a comparison means 64 which compares signal $E_3$ with a signal $E_4$ corresponding to the desired transverse oxygen, temperature or other gradient at the points being monitored such that a control signal $E_5$ is generated. The control signal $E_5$ is then applied to a control means 66 which regulates the amount of regeneration gas introduced into the spent catalyst line via line 40. Thus, as would be obvious to one skilled in the art, the greater the deviation from the desired oxygen gradient (i.e., the greater the amount of volatile hydrocarbon introduced into bed 30), the greater will be the amount of regeneration gas employed in line 40.

Referring to FIG. 3, an alternate embodiment for practicing the subject invention is disclosed. The operation of this embodiment is generally similar to that previously described in FIGS. 1 and 2. In this embodiment, riser reaction zone 110 comprises a tubular, vertically extending vessel having a relatively large height in relation to its diameter. Reaction zone 110 communicates with a disengagement zone 120, shown located a substantial height above regeneration zone 150. The catalyst circulation rate is controlled by a valve means, such as slide valve 180, located in spent catalyst transfer line 140 extending between disengagement zone 120 and regeneration zone 150. In this embodiment hydrocarbon feedstock is injected through line 112 into riser reaction zone 110 having a fluidized bed of catalyst to catalytically crack the feedstock. Steam may be injected through lines 160 and 162 into return line 158 extending between regeneration zone 150 and reaction zone 110 to serve as a diluent, to provide a motive force for moving the hydrocarbon feedstock upwardly and for keeping the catalyst in a fluidized condition.

The vaporized, cracked feedstock products pass upwardly into disengagement zone 120 where a substantial portion of the entrained catalyst is separated. The gaseous stream then passes through a gas-solid separation means, such as two stage cyclone 122, which further separates out entrained catalyst and returns it to the disengagement zone through diplegs 124, 126. The gaseous stream passes into plenum chamber 132 and exits through line 130 for further processing (not shown). The upwardly moving catalyst in reaction zone 110 gradually becomes coated with carbonaceous material which decreases its catalytic activity. When the catalyst reaches the top of reaction zone 110 it is redirected by grid 128 into stripping zone 140 in spent catalyst transfer line 142 where it is contacted by a stripping gas, such as steam, entering through line 144 to partially remove the remaining volatile hydrocarbons from the spent catalyst. The spent catalyst then passes through spent catalyst transfer line 142 into dense phase catalyst bed 152 of regeneration zone 150. Oxygen containing regeneration gas enters dense phase catalyst bed 152 through line 164 to maintain the bed in a turbulent fluidized condition, similar to that in riser reaction zone 110. Regenerated catalyst gradually moves upwardly through dense phase catalyst bed 152 eventually flowing into overflow well 156 communicating with return line 158. Return line 158 is shown exiting through the center of dense phase catalyst bed 152, and communicating with riser reaction zone 110.

Flue gas formed during the regeneration of the spent catalyst passes from the dense phase catalyst bed 152 into dilute catalyst phase 154. The flue gas then passes through cyclone 170 into plenum chamber 172 prior to discharge through line 174. Catalyst entrained in the flue gas is removed by cyclone 170 and is returned to catalyst bed 152 through diplegs 176, 178.

As indicated for the previous embodiment, hydrocarbons not removed from the spent catalyst in stripping zone 140 are combusted in preference to the coke on the spent catalyst in dense phase catalyst bed 152. Thus, the area where the spent catalyst is discharged into dense phase catalyst bed becomes deficient in oxygen resulting in the formation of CO rather than $CO_2$, while excess oxygen will be present in other areas of dense phase catalyst bed 152. Where excess oxygen is present, the coke is completely converted to $CO_2$ and free oxygen also passes into the dilute catalyst phase 154, thereby resulting in the formation of dilute phase transverse oxygen gradients. When the CO from thee oxygen deficient area contacts the excess oxygen in the dilute catalyst phase, undesired afterburning results from the conversion of the CO to $CO_2$. In this embodiment, the afterburning can be significantly reduced by more completely combusting the volatile hydrocarbons prior to their entry into dense phase bed 152. This may be accomplished by introducing a minor portion of the regeneration gas through line 190 into spent catalyst transfer line 142. The point at which the regeneration gas is injected into transfer line 142 may be less critical in this embodiment than that in the previous embodiment since here the catalyst recirculation rate is controlled by slide valve 180, rather than by the pressure in the transfer line. The regeneration gas preferably is injected downstream of slide valve 180, most preferably close to regeneration zone 150 to minimize the effect of the regeneration gas on the catalyst flow rate and preclude operational problems. If the regeneration gas were injected upstream of slide valve 180, this might cause over-fluidization of the catalyst in the transfer line 142 and enable regeneration gas to enter stripping zone 140 resulting in high heat release. Injection of regeneration gas downstream of, but close to, slide valve 180 also may affect the catalyst flow rate, but here the effect would be much less pronounced. Therefore, to minimize the effect of the regeneration gas on the catalyst flow rate, the gas should be injected relatively close to regeneration zone 150. One method of discharging the regeneration gas into transfer line 142 relatively close to regeneration zone 150 is to at least partially dispose a conduit means 192 communicating with line 190 in spent catalyst transfer line 142, with the conduit means terminating substantially near the terminus of the transfer line in dense phase catalyst bed 152. Irrespective of whether a conduit means is disposed in line 142, the amount of regeneration gas added through line 190 preferably should be regulated as in the previous embodiment to minimize catalyst entrainment, and also to minimize transverse oxygen gradients. The relative amount of regeneration gas added through lines 164 and 190 can be regulated by control valve 194 in line 190. Valve 194 is controlled in a manner similar to valve 66 shown in FIG. 2, the schematic control drawing for the embodiment of FIG. 1. Typically, it is believed that about 4% to about 16% of the total regeneration gas should be added to spent catalyst transfer line 142 through line 190, and preferably between about 8% and about 14% of the total regeneration gas.

Therefore, combustion of the volatile hydrocarbons in mixture with the spent catalyst prior to said mixture entering the dense phase catalyst bed insures that the regeneration gas passing upward through the grid in said bed will burn only the carbon on the catalyst which is mixed throughout the bed. As such, the present invention serves to correct an imbalance in the amount of combustible material present in a localized area of the dense phase catalyst bed by removing a portion of said combustible material (the volatile hydrocarbons) prior to their entering the bed. In addition, precombustion of the volatile hydrocarbons serves to prevent or minimize localized starvation of oxygen in the dense phase catalyst bed such that formation of CO rather than $CO_2$ is minimized. As such, there will be virtually no transverse oxygen gradients in the gases leaving the dense phase catalyst bed, thereby minimizing or preventing undesirable or excessive afterburning. As illustrated in FIG. 2, this can be done simply and conveniently on a continuous basis.

In general, any commercial catalytic cracking catalyst designed for high thermal stability could be suitably employed in the present invention. Such catalysts include those containing silica and/or alumina. Catalysts containing combustion promoters such as platinum also can be used. Other refractory metal oxides such as magnesia or zirconia may be employed and are limited only by their ability to be effectively regenerated under the selected conditions. With particular regard to catalytic cracking, preferred catalysts include the combinations of silica and alumina, containing 10 to 50 wt. % alumina, and particularly their admixtures with molecular sieves include both naturally occurring and synthetic aluminosilicate materials, such as faujasite, chabizite, X-type and Y-type aluminosilicate materials and ultra stable, large pore crystalline aluminosilicate materials. When admixed with, for example, silica-alumina to provide a petroleum cracking catalyst, the molecular sieve content of the finished fresh catalyst particles is suitably within the range from 5–15 wt. %, preferably 8–10 wt. %. An equilibrium molecular sieve cracking catalyst may contain as little as about 1 wt. % crystalline material. Admixtures of clay-extended aluminas may also be employed. Such catalysts may be prepared in any suitable method such as by impregnated, milling, co-gelling and the like, subject only to provision of the finished catalyst in a physical form capable of fluidization.

As noted previously, the regeneration zone employed in the present invention normally comprises vertical cylindrical vessels wherein the catalyst to be regenerated is maintained as a fluidized bed by the upward passage of an oxygen-containing regeneration gas thereby forming a dense phase catalyst bed and a dilute catalyst phase with an interface in between. The dense phase bed, which is usually located in the lower portion of the regeneration zone, is maintained at a temperature in the range of from about 1150°–1350° F., preferably from about 1250°–1320° F. The density of the dense phase bed may range from about 8 to about 30 lb/cu. ft.

The dilute catalyst phase is the primarily gaseous phase volume located above the dense phase bed within the regeneration zone. Specifically, the dilute phase contains relatively small quantities of catalyst compared to the dense phase bed. For example, the density of the dilute phase zone ranges from about 0.1 to about 1.0 lb/cu. ft. at the inlet to the separation means and from about 1 to about 5 lb/cu. ft. near the interface between the dense bed phase and the dilute catalyst phase. In many instances, the overall flow in the dilute phase is a concurrent flow of catalyst entrained with flue gases. It is contemplated that the dilute catalyst phase can include substantial quantities of the dense bed material which passes into that phase from excessive agitation or bubbling of gaseous materials through the dense bed. In general, the temperature in the dilute catalyst phase is at least that in the dense bed phase and is advantageously maintained within the range from about 1200° to about 1450° F., preferably from about 1350° to about 1400° F.

The term "substantially catalyst-free flue gas" is the gaseous phase volume located within or downstream of the catalyst separation means within the regeneration zone. Specifically, the "substantially catalyst-free flue gas" comprises flue gas from the dilute catalyst phase from which entrained catalyst particles have been substantially removed. This corresponds to the gaseous effluent from the separation means within the regeneration zone wherein the concentration of entrained catalyst particles will be less than about 1, preferably less than about 0.2 grains per actual cubic foot. The term "actual cubic foot" refers to the volume measured at actual operating conditions without correction to a standard temperature and pressure. The substantially catalyst-free flue gas from the separation means may be discharged to a variety of downstream equipment such as a dispersion means to redistribute the flue gas, stack valves, a plenum chamber and the like, prior to leaving the regeneration zone. By the use of the method of the present invention, substantial afterburning, and hence excessive temperatures in that portion of the regeneration zone wherein the flue gas is substantially catalyst-free, may be avoided. Preferably, the temperature in that portion of said regeneration zone is maintained at least equal to that of the dilute catalyst phase at the inlet to the separation devices but no more than 50° F., preferably no more than 30° F., and most preferably no more than 20° F., above that at said inlet. Although not necessary to the practice of the present invention, extraneous cooling means such as steam may be employed to further reduce the temperature and thereby inhibit the afterburning reaction in that portion of the regeneration zone wherein the flue gas is substantially catalyst-free.

One or more gas-solids separation means may be utilized in the dilute catalyst phase to separate entrained regenerated catalyst particles from the regeneration gas. Preferred separation means will be cyclone separators, multiclones or the like whose design and construction are well known in the art. In the case of cyclone separators, a single cyclone may be used, but preferably, more than one cyclone will be used in parallel or in series flow to effect the desired degree of separation.

The construction of the regeneration zone can be made with any material sufficiently able to withstand the relatively high temperatures involved when afterburning is encountered within the vessel and the high attrition conditions which are inherent in systems wherein fluidized catalyst is regenerated and transported. Specifically, metals are contemplated which may or may not be lined. More specifically, ceramic liners are contemplated within any and all portions of the regeneration zone together with alloy use and structural designs in order to withstand the erosive conditions and temperatures of about 1400° F. and, for reasonably short periods of time, temperatures which may be as high as 1800° F.

The pressure in the regeneration zone is usually maintained in a range from about atmospheric to about 50 psig., preferably from about 10 to 50 psig. It is preferred, however, to design the regeneration zone to withstand pressures of up to about 100 psig. Operation of the regeneration zone at increased pressure has the effect of promoting the conversion of carbon monoxide to carbon dioxide and reducing the temperature level within the dense bed phase at which the substantially complete combustion of carbon monoxide can be accomplished. The higher pressure also lowers the equilibrium level of carbon on regenerated catalyst at a given regeneration temperature.

The residence time of the spent catalyst in the regeneration zone is not critical. In general, it can vary from about 1 to about 6 minutes; typically, from about 2 to about 4 minutes. The contact time or residence time of the flue gas in the dilute catalyst phase establishes the extent to which the combustion reaction can reach equilibrium. The residence time of the flue gas may vary from about 10 to about 60 seconds in the regeneration zone and from about 2 to about 15 seconds in the dense bed phase. Preferably, the residence time of the flue gas varies from about 15 to about 20 seconds in the regeneration zone and from about 6 to about 10 seconds in the dense bed.

The present invention may be applied beneficially to any type of fluid cat cracking unit with little or no modifications and without limitations as to the spatial arrangement of the reaction, stripping, and regeneration zones thereof. The regeneration zone of a catalytic cracking unit can be designed independently from the reaction zone since the regeneration zone merely receives spent catalyst, oxidizes the coke thereon to regenerate the catalyst, and returns the regenerated catalyst to the reaction zone. Therefore, the reaction zone can be a pure transfer line, i.e. one in which the reaction occurs in a single pipe type vessel directly terminating in a rough cut cyclone or cyclones as in FIG. 3, a conventional dilute riser/dense bed combination as in FIG. 1, or a dense bed alone.

While the invention has been descirbed in connection with specific embodiments, it will be understood that this invention is capable of further modification, and that this application is intended to cover any variations, uses or adaptations of the invention and including such departures from the present disclosure as come within known or customary practice in the art to which the invention pertains and as may be applied to the essential features hereinbefore set forth, and as fall within the scope of the invention.

What is claimed is:

1. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom, thereby forming a mixture of coke contaminated catalyst and unstripped volatile hydrocarbons;

(C) passing the mixture from the reaction zone through a transfer line into the dense phase catalyst bed of a regeneration zone having a dense phase catalyst bed and a dilute catalyst phase;

(D) regenerating the coke contaminated catalyst by contacting the mixture under regeneration conditions with an oxygen-containing regeneration gas, the improvement which comprises: injecting a minor portion of the regeneration gas into the transfer line to at least partially combust the remaining volatile hydrocarbons from the mixture, the minor portion of the regeneration gas being injected into the transfer line at a point relatively close to the regeneration zone to minimize the effect of the injection of the minor portion of regeneration gas on the catalyst flow rate through the transfer line;

(E) monitoring the temperature of the gas in the dilute phase in at least two points; and, (F) adjusting the amount of the minor portion of the regeneration gas injected into the transfer line to regulate the temperature difference between the two points.

2. The process of claim 1 wherein the minor portion of the regeneration gas is injected into the transfer line through a conduit means at least partially disposed in the transfer line.

3. The process of claim 1 wherein the mixture flow rate through the transfer line is controlled by the injection of regeneration gas into the transfer line at a location spaced apart from the point at which the minor portion of the regeneration gas is injected into the transfer line.

4. The process of claim 3 wherein the minor portion of the regeneration gas comprises about 2% to about 10% of the total regeneration gas.

5. The process of claim 4 wherein the minor portion of the regeneration gas comprises about 3% to about 6% of the total regeneration gas.

6. The process of claim 1 wherein the mixture flow rate through the transfer line is regulated by a valve means disposed in the transfer line.

7. The process of claim 6 wherein the minor portion of the regeneration gas comprises about 4% to about 16% of the total regeneration gas.

8. The process of claim 7 wherein the minor portion of the regeneration gas comprises about 8% to about 14% of the total regeneration gas.

9. In a fluidized catalytic cracking process comprising:

(A) contacting a hydrocarbon feedstock with cracking catalyst in a reaction zone under cracking conditions to produce cracked hydrocarbon vapors and coke contaminated catalyst:

(B) contacting the coke contaminated catalyst with a stripping gas to partially remove volatile hydrocarbons therefrom thereby forming a mixture of coke contaminated catalyst and unstripped volatile hydrocarbons; and (C) passing the mixture through a transfer line into a regeneration zone having a dense phase catalyst bed and a dilute catalyst phase; and (D) regenerating the coke contaminated catalyst be contacting the mixture under regeneration conditions with an oxygen-containing regeneration gas, the improvement which comprises:

(i) monitoring the temperature of the regeneration gas at two spaced-apart points in the dilute catalyst phase;

(ii) injecting a minor portion of the regeneration gas into the transfer line to combust the unstripped volatile hydrocarbons in the mixture; and (iii) periodically adjusting the amount of the minor portion of the regeneration gas injected into the transfer line to regulate the temperature difference between the two points.

10. The process of claim 9 wherein the minor amount of the regeneration gas is injected into the transfer line substantially close to the regeneration zone.

11. The process of claim 10 wherein the minor amount of regeneration gas injected into the transfer line is injected through a conduit means, at least a portion of the conduit means disposed in the transfer line.

12. The process of claim 9 wherein the two points at which the temperature is monitored are located in a plane substantially transverse to the flow of regeneration gas through the dilute catalyst phase.

13. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst and unstripped volatile hydrocarbons;

(C) passing the mixture through a transfer line into a regeneration zone having a dense phase catalyst bed and a dilute catalyst phase; and (D) regenerating the coke contaminated catalyst by contacting the mixture under regeneration conditions with an oxygen-containing regeneration gas, the improvement which comprises:

(i) monitoring the oxygen concentration of the gas at two spaced-apart points in the dilute catalyst phase;

(ii) injecting a minor portion of the regeneration gas into the transfer line to combust the unstripped volatile hydrocarbons; and (iii) periodically adjusting the amount of the minot portion of the regeneration gas injected into the transfer line to thereby regulate the difference in oxygen concentration between the two points.

14. The process of claim 13 wherein the spaced-apart points at which the oxygen concentration is monitored are disposed in a plane substantially transverse to the direction of gas flow through the dilute catalyst phase.

15. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst and unstripped volatile hydrocarbons;

(C) passing the mixture through a transfer line into a regeneration zone having a dense phase catalyst bed and a dilute catalyst phase; and (D) regenerating the coke contaminated catalyst by contacting the mixture under regeneration conditions with an oxygen-containing regeneration gas, the improvement which comprises:

(i) monitoring the hydrocarbon concentration at two spaced-apart points in the dilute catalyst phase;

(ii) injecting a minor portion of the regeneration gas into the transfer line to combust the unstripped volatile hydrocarbons; and (iii) periodically adjusting the amount of the minor portion of the regeneration gas injection into the transfer line to regulate the difference in hydrocarbon concentration between the two points.

16. In a fluidized catalytic cracking process comprising:

(A) contacting a hydrocarbon feedstock with cracking catalyst in a reaction zone under cracking conditions to produce cracked hydrocarbon vapors and coke contaminated catalyst;

(B) contacting the coke contaminated catalyst with a stripping gas to partially remove volatile hydrocarbons therefrom thereby forming a mixture of coke contaminated catalyst, unstripped volatile hydrocarbons, and a non-hydrocarbon oxidizable component;

(C) passing the mixture through a transfer line into a regeneration zone having a dense phase catalyst bed and a dilute catalyst phase; and (D) regenerating the coke contaminated catalyst by contacting the mixture under regeneration conditions with an oxygen-containing regeneration gas, the improvement which comprises:

(i) monitoring the concentration of the non-hydrocarbon oxidizable component at two spaced-apart points in the dilute catalyst phase;

(ii) injecting a minor portion of the regeneration gas into the transfer line to combust the unstripped volatile hydrocarbons and oxidize at least a portion of the non-hydrocarbon oxidizable component; and (iii) periodically adjusting the amount of the minor portion of the regeneration gas injected into the transfer line to thereby regulate the difference in the concentration of the non-hydrocarbon oxidizable component between the two points.

17. The process of claim 16 wherein the non-hydrocarbon oxidable component monitored is selected from the class consisting of carbon monoxide, ammonia, hydrogen, and oxides of nitrogen.

18. The process of claim 9 wherein the temperature difference between the two points is minimized.

19. The process of claim 13 wherein the difference in oxygen concentration is minimized.

* * * * *

UNITED STATES PATENT AND TRADEMARK OFFICE

CERTIFICATE OF CORRECTION

PATENT NO. : 4,243,518

DATED : January 6, 1981

INVENTOR(S) : Edward C. Luckenbach

It is certified that error appears in the above—identified patent and that said Letters Patent is hereby corrected as shown below:

Figure 1 should appear as shown on the attached sheet.

Signed and Sealed this

*Ninth* Day of *March 1982*

[SEAL]

*Attest:*

GERALD J. MOSSINGHOFF

*Attesting Officer*

*Commissioner of Patents and Trademarks*